US007686294B2

(12) United States Patent
Moore

(10) Patent No.: US 7,686,294 B2
(45) Date of Patent: Mar. 30, 2010

(54) AUTOMATICALLY VARIABLY TILTING SUPPORTING TRAY FOR NON-UNIFORM-THICKNESS PRINT MEDIA

(75) Inventor: Kenneth P. Moore, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 326 days.

(21) Appl. No.: 11/289,890

(22) Filed: Nov. 30, 2005

(65) Prior Publication Data

US 2007/0120318 A1 May 31, 2007

(51) Int. Cl.
*B65H 1/08* (2006.01)

(52) U.S. Cl. ..... 271/148

(58) Field of Classification Search ..... 271/148, 271/152, 162
See application file for complete search history.

(56) References Cited

U.S. PATENT DOCUMENTS 3,567,216 A * 3/1971 Zeller ..... 271/148
4,711,443 A * 12/1987 Fujiwara et al. ..... 271/126
5,302,080 A * 4/1994 Smith et al. ..... 414/788.2
5,364,087 A * 11/1994 Schieck et al. ..... 271/148
5,419,645 A * 5/1995 Russo ..... 400/624
6,142,689 A * 11/2000 Margiotta ..... 400/624
6,186,492 B1 * 2/2001 Dechau et al. ..... 271/30.1
6,283,469 B1 * 9/2001 Weber ..... 271/148
6,290,225 B1 * 9/2001 Linder et al. ..... 271/155
6,315,284 B1 * 11/2001 Komuro et al. ..... 271/127
7,267,337 B2 * 9/2007 Moore et al. ..... 271/148
2006/0284366 A1 * 12/2006 Van Dongen et al. ..... 271/148
2007/0257419 A1 * 11/2007 Wilcox et al. ..... 271/148

FOREIGN PATENT DOCUMENTS

JP 59078013 * 5/1984
JP 62031623 * 2/1987
JP 05058505 * 3/1993

OTHER PUBLICATIONS

U.S. Appl. No. 11/111,823, filed Apr. 22, 2005 by Richard A. VanDongen, et al, entitled "Tray for Non-Uniform Thickness Objects," projected to be published by the USPTO on about Oct. 22, 2006.

* cited by examiner

*Primary Examiner*—Patrick H Mackey
*Assistant Examiner*—Patrick Cicchino
(74) *Attorney, Agent, or Firm*—Fay Sharpe LLP

(57) ABSTRACT

A system and method of fully supporting, substantially planarly, a variable thickness stack of non-uniform thickness print media sheets on a single integral and substantially planer pivotal supporting tray which is automatically variably tilted in response to the height of the stack by being mounted on, and moved by, an existing elevator tray, the vertical movement of which automatically changes the pivotal tilt angle of the tray by a lever arm pivotal connection between the pivotal tray and a fixed position to maintain the top sheet of the stack substantially horizontal as the stack thickness changes while the elevator tray is simultaneously vertically moving the pivotal tray.

4 Claims, 3 Drawing Sheets

Figure 1:
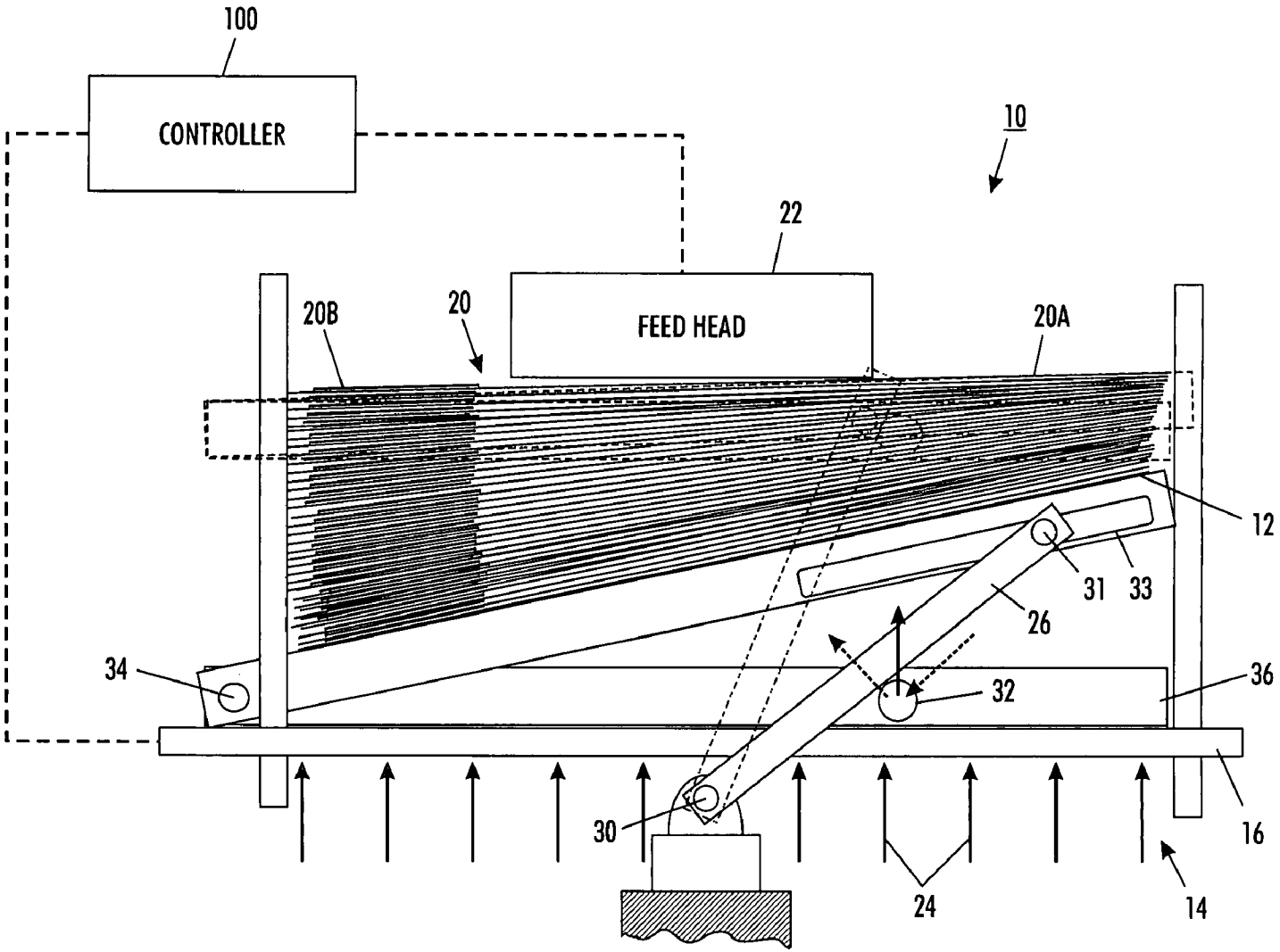

AUTOMATICALLY VARIABLY TILTING SUPPORTING TRAY FOR NON-UNIFORM-THICKNESS PRINT MEDIA

Cross-reference [not a priority claim] is made to a copending and commonly owned U.S. application Ser. No. 11/111,823 filed Apr. 22, 2005 by Richard A. VanDongen, et al, entitled "Tray for Non-Uniform Thickness Objects," projected to be published by the USPTO on about Oct. 22, 2006.

Disclosed in the embodiments herein is a simple and relatively low cost modular sheet stacking unit, readily insertable into many existing sheet stacking trays for operation therewith, for supporting non-uniform thickness print media sheets or sheet sets on a sheet supporting tray that can automatically variably tilt to provide horizontal or level top sheet feeding or stacking even if the stack height of said sheets is very different on one side of the stack than the other and that difference varies considerably with the total number of such uneven thickness sheets or sheet sets in the stack.

By way of further background, of particular interest is a prior Xerox Corp. U.S. Pat. No. 5,364,087 issued Nov. 15, 1994 to Richard A. Schieck, et al, entitled "Tilting Tray for Feeding and Stacking Specialized Forms," and its cited references, incorporated by reference herein. It describes a modular insert for an print media sheets elevator tray for providing a substantially level top sheet surface for a variable height stack of multiple specialized forms having peelable labels in a marginal area thereof which causes these specialized sheets to have a greater thickness in that area than in the rest of the sheet. As may be seen from this patent, this is provided there by making approximately half of the stack bottom supporting surface 209 pivotable downward with the weight of the stack in that thicker area against the force of springs 212, 214, as described in Col. 8, for example. This disclosed counter-spring partial stack support pivoting system apparently assumes consistent correlation of stack height to stack end area weight downward force, minus sheet beam strength, versus spring upward force. Col. 8, lines 39-45 of this patent also incidentally mentions, but does not show, that: "... instead of using a spring mounted support for the thicker marginal region, a ratchet arrangement of a rack and pinion may be used wherein the support is moved down the requisite distance to insure that the leading and trailing marginal regions of the uppermost sheet of the stack of copy sheets are substantially level." However, even if the latter suggestion were enabled (which would seem to require some sort of additional controlled drive, not disclosed), all of the bottommost sheets of the stack of sheets will still be variably significantly bent, as shown in this patent, because only one portion of the stack support tilts while the other portion remains fixed horizontally. In contrast, inter alia, the embodiment disclosed herein can desirably maintain most of the stacked special sheets substantially planar irrespective of the number of multiple sheets being stacked (the stack height) or the stack weight.

Other known tilting trays include a reportedly spring loaded hinged stacking tray for the output of stapled sets of printed sheets (sets that are thicker on their stapled side) that is hinged downstream to tilt down upstream (adjacent the sheet exit tray entrance area) to reduce uneven stack growth due to the staples or other set bindings. This is reportedly in the Océ 3165 copier introduced in approximately 1998. However, spring pivoting trays in general typically have a limited capacity of stacking height as compared to elevator stacking trays, as well as only an approximated appropriate amount or degree of pivoting, as noted above.

One specific feature of the specific embodiment disclosed herein is to provide an uneven thickness print media sheets stacking tray module for a printer which is mountable on an vertically repositioning elevator stacking tray system, said uneven thickness print media sheets stacking tray module having a pivotal sheets stacking tray operatively engaged by said elevator stacking tray system for vertically repositioning said pivotal sheets stacking tray therewith to accommodate the stacking of a stack of a variable number of said uneven thickness print media sheets on said pivotal sheets stacking tray, which uneven thickness print media sheets are thicker in a first area thereof and thinner in an opposing second area thereof, said pivotal sheets stacking tray being substantially planar and unitary to provide substantially continuously planar underlying support of said stack of uneven thickness print media sheets both in said thicker first area thereof and said opposing thinner second area thereof, said uneven thickness print media sheets stacking tray module further including an automatic tilting system operatively connecting to said pivotal sheets stacking tray to automatically tilt said entire unitary and substantially planar pivotal sheets stacking tray downwardly under said thicker first area and upwardly under said thinner opposing second area by a tilt angle of said pivotal sheets stacking tray which increases automatically in response to an increase in the thickness of the uneven thickness print media sheets stacked on said pivotal sheets stacking tray, to maintain the upper surface of said stack of uneven thickness print media sheets substantially horizontal.

Further specific features disclosed in the embodiment herein, individually or in combination, include those wherein said pivotal sheets stacking tray automatic tilting system is driven by said elevator stacking tray system to automatically variably tilt said unitary pivotal sheets stacking tray upwardly under said thicker first area and downwardly under said thinner second area by a tilt angle of said pivotal sheets stacking tray which decreases automatically in response to said uneven thickness print media sheets being fed away from the upper surface of said stack of said uneven thickness print media sheets on said pivotal sheets stacking tray, so as to maintain said upper surface of said stack substantially horizontal; and/or wherein said pivotal sheets stacking tray automatic tilting system comprises a mechanical linkage connecting to said pivotal sheets stacking tray to tilt said pivotal sheets stacking tray at an angle proportional to said vertical repositioning of said elevator stacking tray system; and/or including a base unit, and wherein said pivotal sheets stacking tray is pivotally connected at one side to said base unit, and said base unit rests on top of said elevator stacking tray system, and said vertical repositioning of said elevator stacking tray system automatically provides said variable tilting of said pivotal sheets stacking tray by automatically changing said tilt angle of said pivotal sheets stack supporting tray in response to changes in said thickness of said stack due to changes in said multiple varying number of non-uniform thickness sheets in said stack to maintain said upper surface of said stack substantially horizontal; and/or wherein said pivotal sheets stacking tray automatic tilting system comprises a mechanical link connecting between said pivotal sheets stacking tray and a fixed position to tilt said pivotal sheets stacking tray at an angle proportional to said vertical repositioning of said elevator stacking tray system, and wherein a manual adjustment system is provided for said mechanical link to adjust an initial tilt angle of said pivotal sheets stack supporting tray; and/or wherein said uneven thickness print media sheets are uniform thickness print media sheets with business card stock adhesively attached adjacent to one side thereof; and/or a method of supporting a stack of a multiple varying number of non-uniform thickness sheets on a sheet stack supporting tray, wherein the thickness of said stack of said non-uniform thickness sheets from the top sheet of said stack to the bottom sheet of said stack is different on one side of said stack than the other side of said stack, and wherein that stack thickness difference from one side to the other side substantially varies with the total number of such non-uniform thickness sheets in said stack, comprising stacking the stack of multiple non-uniform thickness sheets fully supported on a single integral and substantially planer sheet stack supporting tray, automatically variably tilting said integral and substantially planer sheet stack supporting tray in response to said thickness of said stack by a tilt angle which provides a substantially horizontal top sheet for said stack, and automatically changing said tilt angle of said sheet stack supporting tray in response to changes in said thickness of said stack due to changes in said varying number of non-uniform thickness sheets in said stack to maintain said top sheet of said stack substantially horizontal; and/or wherein said single integral and substantially planer sheet stack supporting tray is part of a modular unit mountable on an elevating stacking tray, and said elevating of said elevating stacking tray automatically provides said variable tilting of said substantially planer sheet stack supporting tray in response to the said thickness of said stack; and/or wherein said single integral and substantially planer sheet stack supporting tray is part of a modular unit mountable on a vertically movable elevator stacking tray, and wherein said vertical movement of said elevator stacking tray automatically changes said angle of said variable tilting of said entire sheet stack supporting tray by simultaneously vertically moving said sheet stack supporting tray and pivoting said sheet stack supporting tray by a lever arm pivotal connection between said tray and a fixed position.

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software or computer arts. Alternatively, the disclosed control system or method may be implemented partially or fully in hardware, using standard logic circuits or single chip VLSI designs.

The term "reproduction apparatus" or "printer" as used herein broadly encompasses various printers, copiers or multifunction machines or systems, xerographic or otherwise, unless otherwise defined in a claim. The terms "sheet" or "print media" herein interchangeably refer to a usually flimsy physical sheet of paper, plastic, or other suitable physical substrate for images.

As to specific components of the subject apparatus or methods, or alternatives therefor, it will be appreciated that, as is normally the case, some such components are known per se in other apparatus or applications, which may be additionally or alternatively used herein, including those from art cited herein. For example, it will be appreciated by respective engineers and others that many of the particular component mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Figure 2:
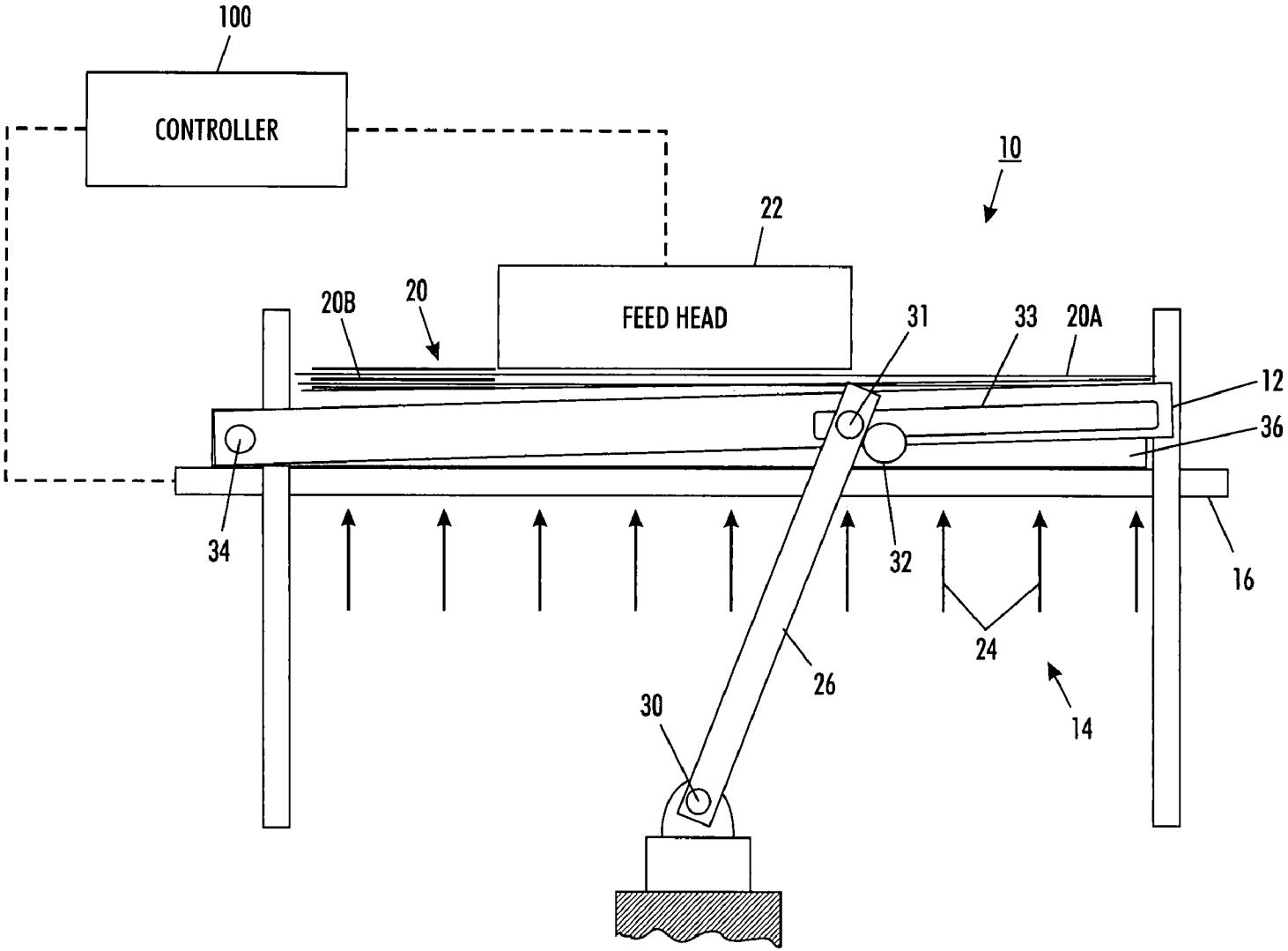
Figure 3:
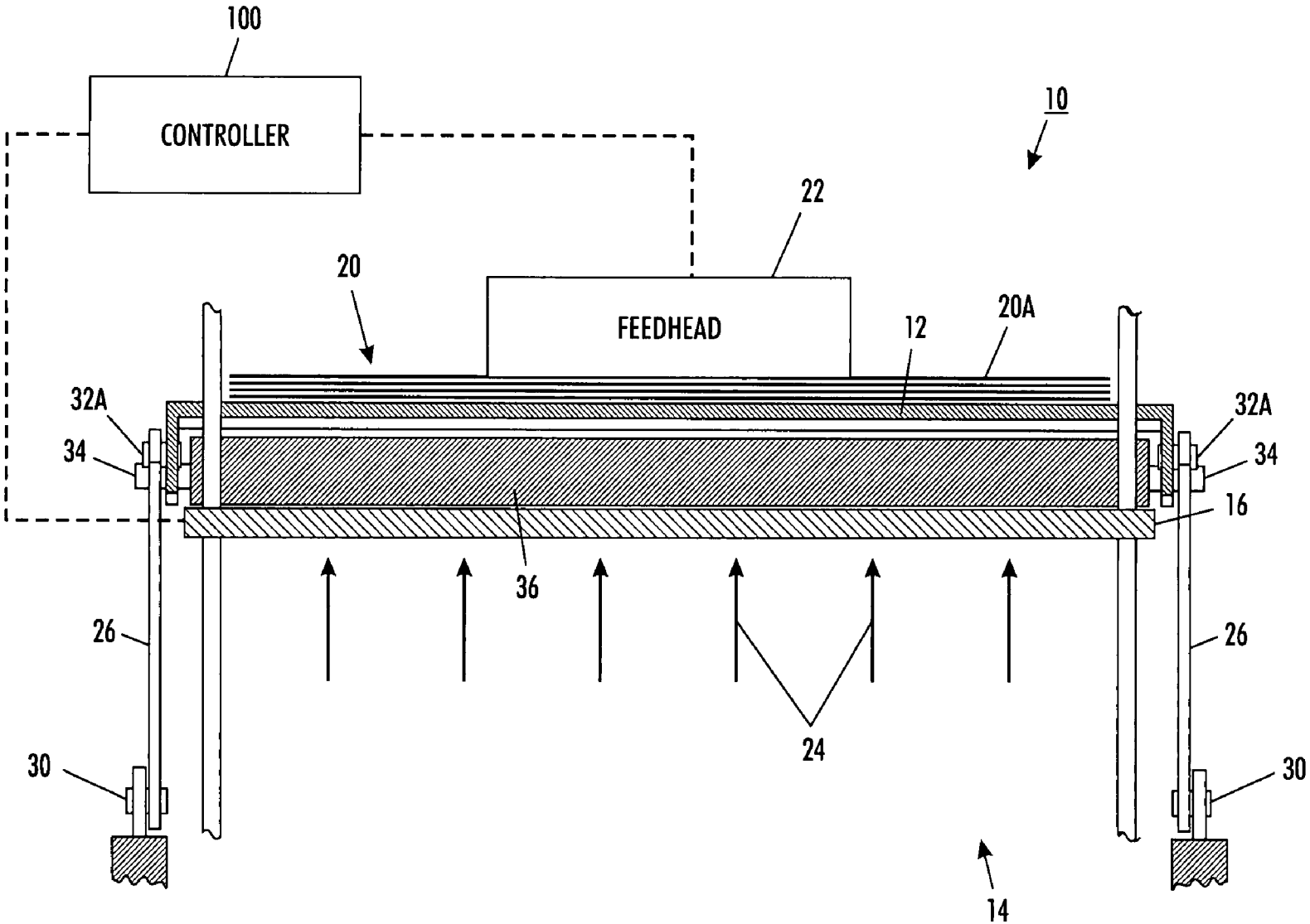

Various of the above-mentioned and further features and advantages will be apparent to those skilled in the art from the specific apparatus and its operation or methods described in the example below, and the claims. Thus, they will be better understood from this description of this specific embodiment, including the drawing figures (which are approximately to scale) wherein:

FIG. 1 is a schematic end view of one example of a modular special sheets feeding unit mounted in a conventional elevator sheet feeding tray for sheets being fed from the top of a stack thereof by a conventional sheet separator/feeder feed head to a conventional printer (not shown), shown in an initial position before sheet feeding after being loaded with a stack of uneven thickness print media sheets;

FIG. 2 is the same as FIG. 1 but showing the position of the respective components as the final remaining uneven thickness sheets have are about to be fed from the stack, or feeding has stopped due to a sensed low stack level; and FIG. 3 is a transverse cross sectional view of FIG. 2.

The embodiment of the Figs. discloses an automatically adjustable sheet feeding tray module optionally insertable into (on top of) various elevatable print media sheet supply trays for improved feeding of special non-uniform thickness print media by maintaining such specialized sheets substantially planer, especially at their feeding position at the top of the stack, for improved sheet feeding reliability with various sheet separator/feeders, etc. Various said elevatable print media sheet supply trays and sheet separator/feeders are well known in the art and need not be described in detail herein. A particular example of such special non-uniform thickness print media is Xerox Corp. "DocuCard"™ sheets. Those are otherwise normal size sheets readily feedable through a xerographic or other printer but bearing thereon peelable or otherwise removable small business card cardstock or other such special printable material on one side area thereof, which additional material significantly increases the overall thickness of each such special sheet on that side area of the sheet.

This illustrated special sheet feeding tray module 10 in this example comprises an automatically pivoting but fully and uniformly sheet stack supporting surface member tray 12 pivotal relative to a mounting base 36, plus linkages 26 on opposite sides, and adjustment features for handling different media sizes and different thickness ratios of non-uniform media. At the full stack or initial sheet feeding position shown in FIG. 1, the existing elevator tray system 14 sheet stacking tray surface 16, on which the module 10 is mounted, is lowered. In this position of that elevator tray surface 16, the full stack underlying and substantially planar special sheet supporting tray surface 12 is automatically appropriately angled to accommodate, without bending, the non-uniform stack 20 of special non-uniform thickness sheets, and to maintain the uppermost such sheet 20A supported substantially planar and horizontal for reliable feeding into the printer by the sheet separator/feeder 22 labeled "Feed Head" in the Figs. As the top sheets 20A are thus sequentially feed out from the stack 20, reducing the height of the stack 20, that may be conventionally sensed with a stack height sensor, feeder sheet engagement sensor, or otherwise, to actuate the elevator tray 14 lifting drive 24 to correspondingly move up the elevator tray surface 16, conventionally or otherwise. These and other such well known control functions are schematically illustrated here by the "controller" 100. The conventional elevator tray system 14 upward movements for sheet feeding move up the module 10 mounting base 36 sitting on the existing elevator tray surface 16. Thus, without the need for any additional drive system, the entire special sheet feeding tray module 10, containing the stack 20 mounted on the pivotal tray 12, also moves up with the existing mechanisms and drives.

As to the exemplary illustrated automatic pivoting of the module 10 tray 12 surface, the tray 12 in this example is pivotally mounted at one side to one side of the base 36 at pivot point 34. A connecting linkage 26 just outside of each side of the module 10, as shown in FIG. 3, extends to and pivotally connects at its upper end with an intermediate pivot point roller or pin 31, which is slideably riding in a slot 33 on the tilting tray 12. The other end of this lever arm or linkage 26 may be fastened in a fixed pivot position 30 to the fixed frame of the machine, such as the frame of the elevator tray system 14. That is, the two respective levers or links 26 here are connecting between the sheet lead edge and sheet trail edge sides of the pivotal tray 12 and "ground" (i.e., the stationary base or respective side of the existing media supply). An adjustable position fixed pivot pin 32 on the base member 36 may intermediately engage the lever arm or linkage 26.

This linkage system correspondingly increasingly un-tilts (raises the right side of the tray at a slower rate than the left end of the tray) as it and the stack 20 are moved up by the elevator tray 16 and approaches (see FIG. 2) its "low paper" or "out of paper" signal level position, i.e., as the tray 16 of the elevator tray system 14 is being gradually lifted up to its top position during sheet feeding and thereby correspondingly lifting up the base member 36. These two interconnecting pivoting lever arms 26 may be made with the illustrated lengths and opposing end pivot point positions 30, 31 and pivot axis 32 as compared to the different pivot axis 34 position of the tray 12, such that the top sheet 20A of the elevating stack 20 of special non-uniform sheets is maintained at a substantially horizontal position for feeding into the existing sheet feeding position of the sheet feeder 22.

The lever system 26 is easily adjustable to alternate positions, such as lateral repositioning of pivot pin 32. This can provide a simple operator adjustment to accommodate different special sheets having different thickness on one side of the sheet than the other, such as different thicknesses of the card stock 20B attached to one side of the special sheets in this example of stack 20, or different initial stack 20 sizes.

To express this in other words, the compact pivoting tray assembly 10 readily mounts on the existing media supply elevator tray system 14, with its base 36 resting on and overlying the existing elevator system media supply tray 16, without requiring any separate drives, springs, or other active components, or requiring any substantially laterally extending space for any levers or other parts. In loading a stack 20 of uneven thickness sheets into this module or assembly 10, even before the start of feeding from this stack 20 of uneven thickness sheets, the stack supporting pivotal tray 12 and its connecting linkage 26 automatically orients substantially horizontally the top sheet 20A by utilizing the position of the elevator tray system 14 tray 16 relative to its fixed frame to operate the linkage 26 to tilt the tray 12 into the correct position. As the existing elevator media supply tray 16 automatically conventionally rises with the feeding out of the variable thickness sheets from the stack 20, the supporting pivotal tray 16 correspondingly automatically pivots to decrease its angle from the horizontal until the supporting tray 16 is substantially horizontal and the tray 16 may align with the base 36 as the final remaining top sheets 20A of the stack 20 are being fed.

Note that this constant re-leveling of the top sheet 20A of the stack as sheets are fed out with this system 10 is desirably independent of the weight of the stack, unlike spring-pivoted tray systems. Also, the pivoting tray 16 does not need to be segmented or intermedially pivotal, and can maintain full planar underlying support of the entire stack 20 at all times, not just initially.

Note that in the example of the Figs. here the sheets 20A are being fed away from the viewer (into the view of FIGS. 1 and 2) by the sheets separator/feeder of feed head 22, and the variable tilting supporting tray 12 is shown tilting sideways about a left side pivot axis 34 parallel the paper path for sheets having their greater thickness on the left side, and with the right side of the pivotal supporting tray 12 pivoting down as sheets are fed out while the existing media supply elevator tray 14 is moving it up. The right side of the stack 20 here lowers from that side of the pivoting tray 12 pivoting down more gradually than the left side of the stack is moving up. However, it will be appreciated that the particular tray tilting orientation or direction of tilt of a particular system will depend on the orientations or directions in which the uneven thickness sheets are desired to be loaded or fed.

As noted, the present system is optionally readily re-settable to more accurately accommodate sheets with different thickness variations or different stack heights. The lower ends of the links 26 may remain fixed to their fixed position pivot 30 mounting on the frame, or be correspondingly adjustable, and can be removable with the module 10. Simply by changing the pivot locations or effective lengths of the links 26 (such as by using commercially available no-tools snap-on or other quick release connections), the operator can adjust for different thickness ratios of different special media, and/or a different stack height capacity.

Thus, although discussed in particular as to a Xerox DocuCard™ sheet feeding system, various other types of non-uniform thickness media can be fed from this simple module. When the underlying elevator media supply system 14 is "homed" to its down position, the initial tray 12 stack supporting angle provided by the adjustable links 26 allows a presetable variable non-uniform height from one side to the other of the tray 12 that corresponds to the particular non-uniform height stack 20 of the non-uniform thickness media being loaded onto it. This allows the top sheet 20A of various different non-uniform thickness media stacks to be initially positionable with a horizontal orientation, as in FIG. 1. As the stack is being depleted the elevator media supply 14 tray 16 raises and the links 26 reduce their tray 12 lifting vector component and cause the initial tilt angle of the tray 12 to continually decrease. This automatically finally results in a substantially horizontal tray 12 orientation when the media supply 20 reaches its lowest allowable level as in FIG. 2.

The disclosed embodiments provide a low cost and compact design, suitable for improved handling of various different special print media in various different printers. As shown, it is optionally adjustable for various desired stack capacities or sheet thickness variation ratios. It provides a positive and controlled supporting tray surface variable tilting movement that is directly related to stack height and stack depletion, which is not dependent on springs to maintain the proper feeding position of the top of the stack, yet no separate power source or controls are required.

Another possible embodiment [not shown] might be to have the free end of the pivotal tray 12 held by one end of an adjustable length string, wire or cable (a flexible rather than rigid linkage) that is fastened at its other end to a fixed position above the tray 12, so that the tray 12 pivots up at an increasing angle as the elevator tray goes down, and is flat when the elevator tray reaches its top position. However, this may require that this cable be wound up on a spool or variable diameter pulley at an appropriate rate as the elevator tray is raised.

While the above example is for an uneven thickness input sheets feeder, unless a claim expressly indicates otherwise, the disclosed system may also encompass and be used for more uniform output stacking of edge stapled sets or other bound sets of sheets with uneven thickness which would otherwise stack unevenly and/or bent. Such as by similarly mounting a similar module in a conventional or other elevator type stacking tray system that moves downwardly as the output stack increases in thickness, and providing a similarly pivoting tray which automatically pivots to increase its tilt to allow more even and/or more horizontal stacking of sheets on top of a stack of sheets which becomes increasingly thicker on one side than the other with an increase in the stack height, just as in the above examples.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A sheet tray module adapted to be mounted on a vertical repositioning elevator tray, said module comprising:

a stack supporting pivotal tray having a slot which is enabled to be pivoted in response to vertical movement of said repositioning elevator tray;

a base unit, wherein said stack supporting pivotal tray is pivotally connected at one side to said base unit at a pivot point, and said base unit rests on top of said vertical repositioning elevator tray;

movable linkages on both sides of said stack supporting pivotal tray, said linkages connected on one end to a fixed pivot position of said module and at its opposite end movably positioned in said slot in said stack supporting pivotal tray;

an adjustable position fixed pivot pin on the base unit that intermediately engages with said movable linkage; and a paper or media feed head enabled to contact a top sheet in a stack of media sheets;

a stack height sensor enabled to sense a height of said stack;

a controller in contact with both said repositioning elevator tray and said paper feed head and provide vertical repositioning movement of said elevator tray and thereby enabled to automatically change a tilt angle of said stack supporting pivotal tray in said stack thickness, said stack supporting pivotal tray enabled to fully and uniformly support a stack of uneven thickness media sheets without bending, said stack supporting pivotal tray comprising an automatic tilting system to automatically tilt said stack supporting pivotal tray downwardly under a thicker first media area and upwardly under a thinner opposing second media area, a tilt angle of said stack supporting pivotal tray increases automatically in response to an increase in a thickness of an uneven thickness print media sheets stacked on said stack supporting pivotal tray.

2. The module of claim 1 wherein said stack supporting pivotal tray automatic tilting system is enabled to be vertically driven by said vertical repositioning elevator tray which is connected to a controller, said elevator stacking tray enabled to automatically variably tilt said stack supporting pivotal tray upwardly at full elevator lift speed under a thicker first area and upwardly at a reduced lift speed using a linkage under a thinner second area by a tilt angle of said stack supporting pivotal tray which decreases automatically in response to said uneven thickness print media sheets being fed away by said feed head from the upper surface of said stack of said uneven thickness print media sheets on said stack supporting pivotal tray, so as to maintain said upper surface of said stacking substantially horizontal.

3. The tray module of claim 1 wherein said stack supporting pivotal tray and its automatic tilting system comprises said movable linkage connecting to said stack supporting pivotal tray to tilt said stack supporting pivotal tray at an angle proportional to said vertical repositioning of said repositioning elevator tray.

4. The sheet tray module of claim 1 wherein said vertical repositioning of said vertical repositioning elevator tray automatically provides said tilting of said stack supporting pivotal tray by automatically changing said tilt angle of said pivotal sheets stack supporting tray in response to changes in said thickness of said stack due to changes in a multiple varying number of non-uniform thickness sheets in said stack to maintain said upper surface of said stack substantially horizontal.

* * * * *